US008684335B2

(12) United States Patent
Hayes

(10) Patent No.: US 8,684,335 B2
(45) Date of Patent: Apr. 1, 2014

(54) PORTABLE HOIST FOR HAND TRUCKS

(76) Inventor: William John Hayes, Long Beach, MS (US)

( * ) Notice: Subject to any disclaimer, the term of this patent is extended or adjusted under 35 U.S.C. 154(b) by 81 days.

(21) Appl. No.: 13/136,706

(22) Filed: Aug. 8, 2011

(65) Prior Publication Data

US 2013/0037768 A1 Feb. 14, 2013

(51) Int. Cl.
*B66D 1/00* (2006.01)

(52) U.S. Cl.
USPC ..... 254/323; 254/326; 254/329; 254/336; 254/338

(58) Field of Classification Search
USPC ..... 254/323, 324, 325, 326, 327, 335, 336, 254/337; 414/541, 542, 543; 224/400
See application file for complete search history.

(56) References Cited

U.S. PATENT DOCUMENTS

| | | | | | |
|---|---|---|---|---|---|
| 1,699,587 | A * | 1/1929 | Grenier | 212/168 |
| 2,315,873 | A * | 4/1943 | Richards | 212/295 |
| 2,440,681 | A * | 5/1948 | Gordon | 414/540 |
| 2,892,555 | A * | 6/1959 | Hooker | 414/543 |
| 3,876,039 | A * | 4/1975 | Bushnell, Jr. | 187/226 |
| 3,948,482 | A * | 4/1976 | Brophy | 254/4 R |
| 4,135,627 | A * | 1/1979 | McInerney | 212/299 |
| 4,388,037 | A | 6/1983 | Suarez | |
| 4,690,248 | A * | 9/1987 | Killeen | 182/118 |
| 4,771,988 | A * | 9/1988 | Scroggins, Sr. | 254/336 |
| 4,934,659 | A | 6/1990 | Yoke | |
| 5,078,364 | A * | 1/1992 | Harrell | 254/387 |
| 5,265,742 | A | 11/1993 | Stenger et al. | |
| 5,294,136 | A * | 3/1994 | Dick et al. | 280/5.2 |
| 5,975,499 | A * | 11/1999 | Ostrobrod | 254/332 |
| 6,152,675 | A | 11/2000 | Compton | |
| 6,189,866 | B1 * | 2/2001 | Harkins et al. | 254/332 |
| 6,234,453 | B1 * | 5/2001 | Block | 254/285 |
| 6,309,168 | B1 * | 10/2001 | Holmes | 414/490 |
| 7,350,770 | B1 * | 4/2008 | Boyer | 254/332 |
| 8,240,683 | B1 * | 8/2012 | Haslup, Sr. | 280/47.29 |
| 2002/0168258 | A1 * | 11/2002 | Philipps et al. | 414/462 |
| 2004/0042886 | A1 * | 3/2004 | Roberts | 414/607 |
| 2004/0256607 | A1 * | 12/2004 | Spitsbergen | 254/334 |
| 2006/0045704 | A1 * | 3/2006 | Laufenberg et al. | 414/543 |
| 2007/0292252 | A1 * | 12/2007 | McGill et al. | 414/634 |
| 2009/0041564 | A1 * | 2/2009 | Borntrager et al. | 414/352 |
| 2009/0173709 | A1 * | 7/2009 | Spitsbergen | 212/292 |

* cited by examiner

*Primary Examiner* — Emmanuel M Marcelo

(57) ABSTRACT

A portable hoist adapted for attachment to a hand truck nose plate is disclosed. The hoist comprises an adapter that sandwiches the nose plate and a hole or holes may be fabricated in the nose plate for securing hardware to be installed, such as a bolt, bolts, strap, etc. Receivers on the hoist hold removable, load supportive legs securely in place. Casters may be attached to legs to improve mobility. A jib assembly capable of several height settings remains reasonably level at all times when in use, making it ideal for tight spaces. The pivot point of the arm is at the end of the mast opposite the adapter assembly, the other end attaching to the handle of the hand truck and securing with a latch. A winch attached to the arm provides a cable extending to and about a sheave or sheaves, terminating beyond the sheave carried at the free end of the jib boom. A brace on the mast allows the arm latch to secure when the arm is collapsed. The jib assembly folds downward with a brake to hold the boom reasonably parallel to the mast. A cable securing hook is attached to the mast, and with slight tension on the cable, the latch brace and cable hook enable the hoist to be carried about easily, utilizing the boom as a handle.

6 Claims, 6 Drawing Sheets

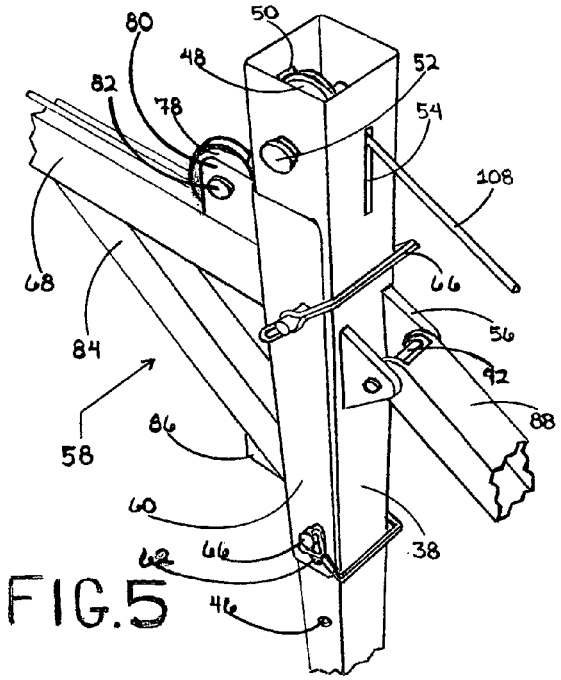
FIG.5
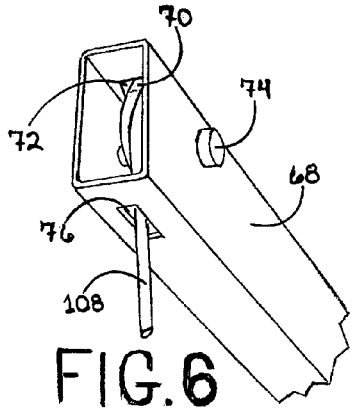
FIG.6
FIG.7
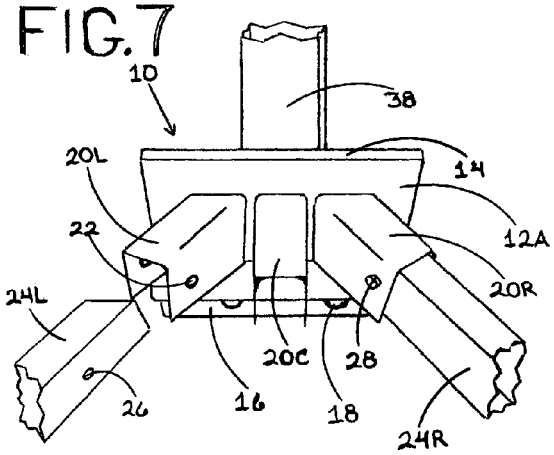
FIG.8
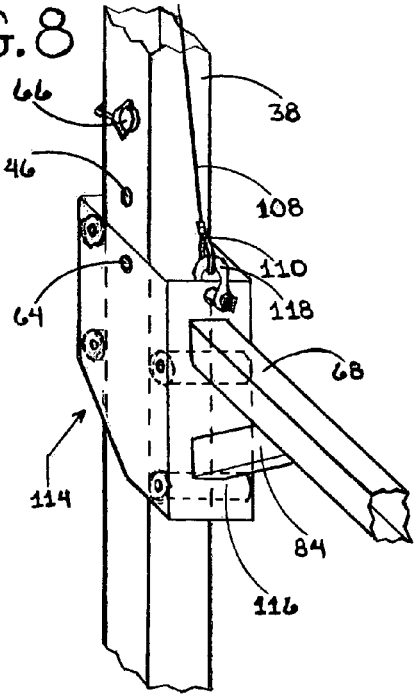

PORTABLE HOIST FOR HAND TRUCKS

BACKGROUND OF THE INVENTION

This invention relates to hoists, specifically to portable and mobile hoists. While many hoists available may accomplish the same task of article manipulation, they all include features which limit the scope of their use. For instance, some are designed to be anchored to a floor, wall or land vehicle. Others are very heavy and bulky, making them a less likely candidate to be used on flat commercial rooftops or in poorly accessible work areas. These limitations force many well designed hoists to be dismissed simply as the wrong tool for the job in situations where the work they accomplish is in demand.

For example, in the commercial HVAC service industry, technicians frequently replace refrigeration compressors and electric fan motors weighing in excess of two hundred pounds. Often, the units containing them are located upon flat rooftops, so an extension ladder, rope and a common hand truck are utilized to get the job done. If the compressor or fan motor is too heavy to safely lift, additional personnel or expensive crane rentals become the only safe and viable alternatives.

Typically, extension ladder hoists are be used to raise a load from the ground surface at the bottom of the ladder to the rooftop. A common hand truck is then used to transport the motor laterally across the roof surface to the air conditioner or air handling unit. However, once the technician arrives at the unit to be repaired, the load must be manually lifted and placed into its compartment, as well as getting the existing load out and carefully setting it down on the roof surface. These compartments are typically one to three feet above the roof surface, creating an unsafe lifting practice, often resulting in injury or property damage. Hence, a mechanical advantage for this and many other similar scenarios is greatly needed.

BRIEF DESCRIPTION OF THE SEVERAL VIEWS OF THE DRAWINGS

FIG. 5 shows a perspective view of the positions of sheaves 1 and 2 as well as the cable routing through the upper end of the mast and the jib assembly.

FIG. 6 shows a perspective view of the position of sheave 3 as well as the cable routing at the free end of the boom.

FIG. 7 shows the adapter assembly and the inserted as well as removed positions of the legs into and from their respective receivers.

FIG. 8 shows an alternative embodiment design of the jib assembly, employing a trolley style bracket with caged roller bearings and no sheaves.

DETAILED DESCRIPTION OF THE PREFERRED EMBODIMENT

Figure 1:
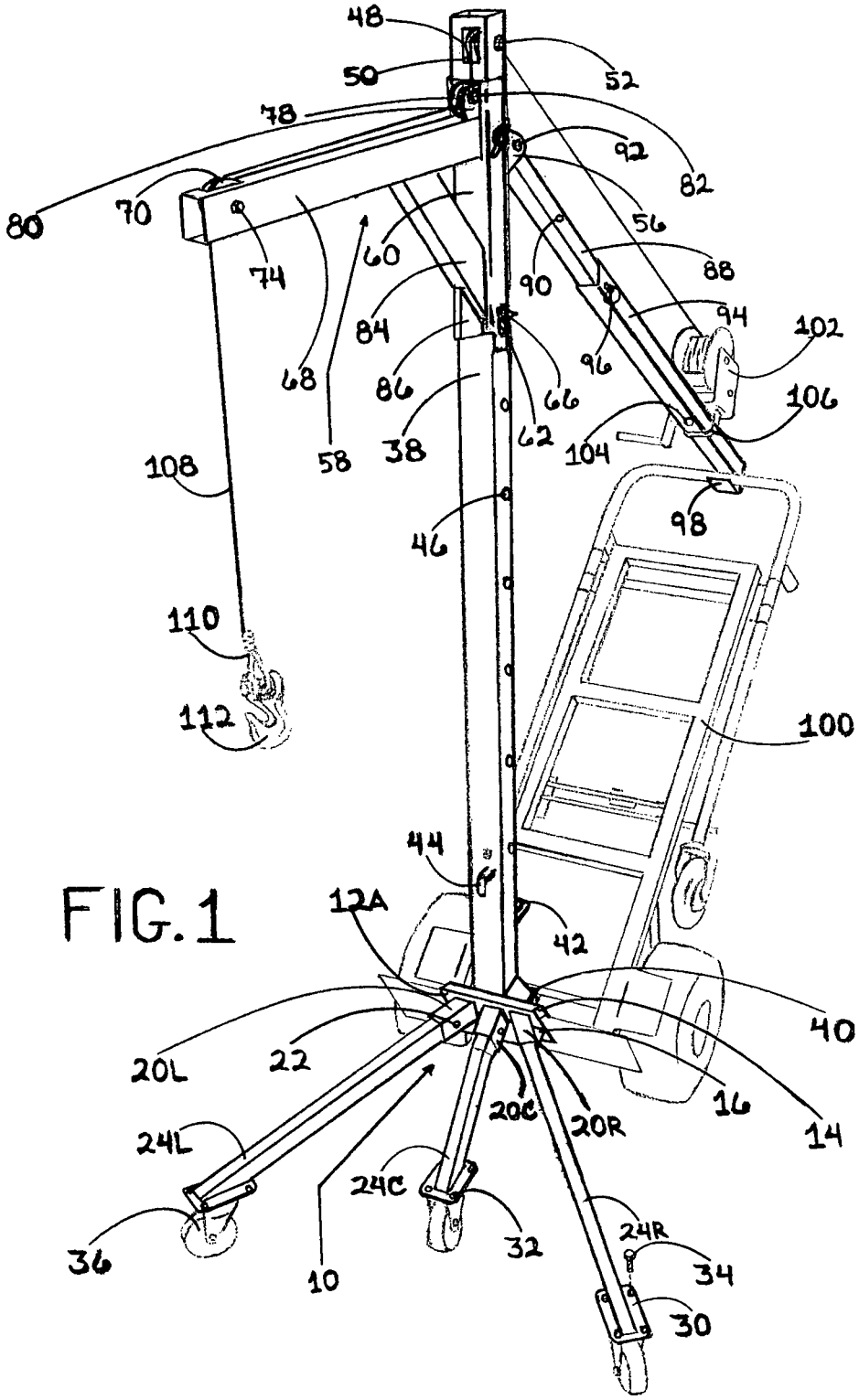
FIG. 1 shows the hoist attached to a hand truck in the upright operational position.

An adapter assembly 10, shown in FIGS. 1-4 and 7, is made of rigid, forged, and/or extruded parts attached to one another at desirable contact points. Assembly 10 is comprised of: adapter plates 12A,B; an adapter plate bridge 14; an adapter angle brace 16; three leg receivers 20L,C,R.

Adapter plates 12A,B, shown in FIGS. 1-4 and 7, are made of flat, rigid material of a predetermined size, shape, and thickness. The two plates maintain sufficient parallel positioning with respect to each other as they are bridged together by adapter plate bridge 14 made of a long, narrow segment of flat, rigid material of adequate size, length, shape and thickness.

Adapter brace 16, made of a segment of angle iron, angle brace material, or the like, is attached flatly against plate 12A upon the surface which faces away from plate 12B, while remaining parallel to the lengthwise dimension of bridge 14. In the preferred embodiment, the exposed outside surface of brace 16 faces bridge 14 when attached to plate 12A.

As is shown in FIG. 7, leg receivers 20L,C,R are made of rigid, C-shaped channel material of a desired size, length, and thickness, and are attached to the outside surface of brace 16 that is perpendicular to plate 12A and facing bridge 14. A leg receiver hole or holes 22 formed in receivers 20L,C,R, should be of adequate diameter and position so as to allow passage of a leg securing pin 28, such as a detent pin, a clevis pin, or the like.

Figure 2:
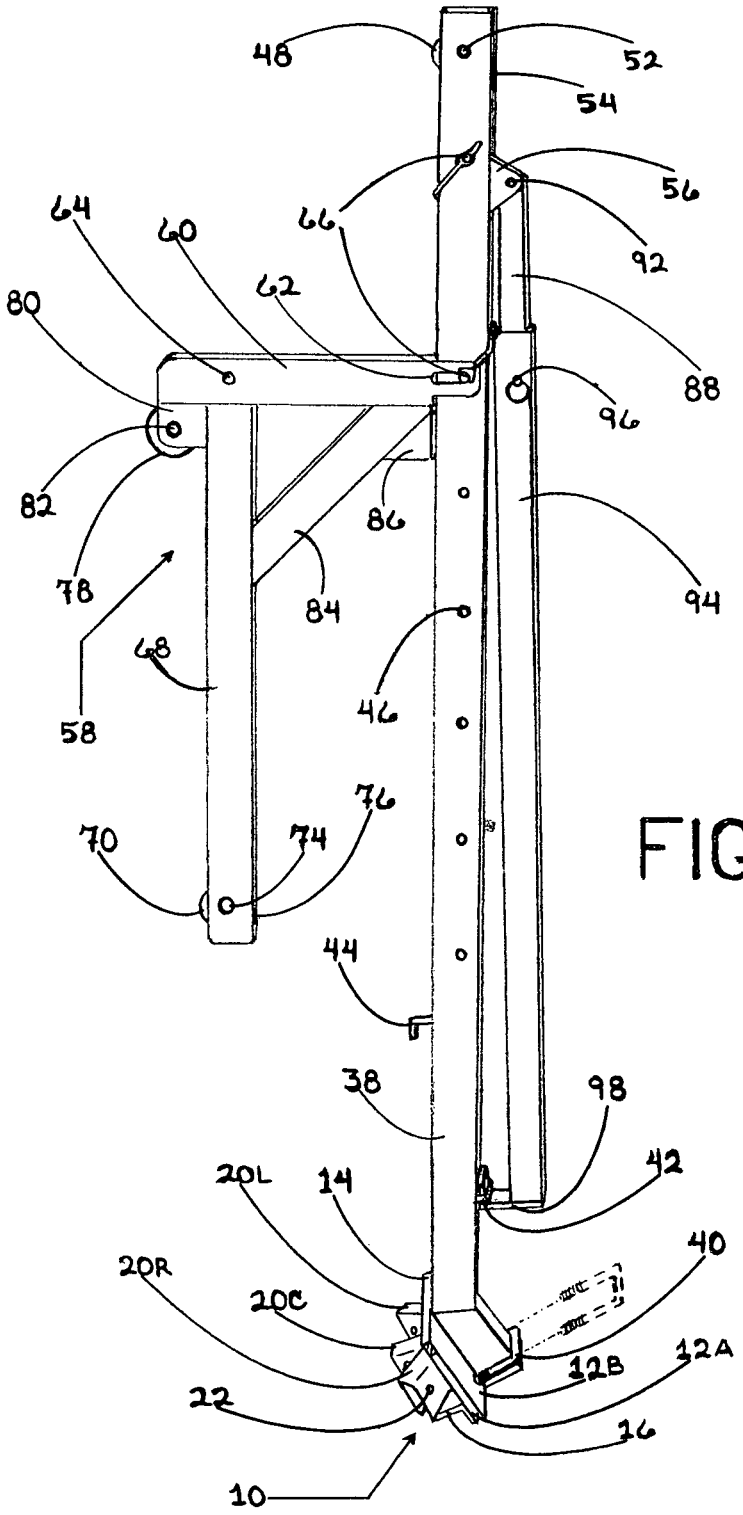
FIG. 2 shows the hoist in the collapsed position with the legs detached.

An adapter mounting hole or holes 18, also shown in FIG. 7, are formed in plates 12A,B and brace 16. The holes should be of sufficient diameter, alignment, and position so as to allow passage of a preferred fastener or fasteners, such as a mast strap 40, comprising a U-shaped bolt or bolts, as is illustrated in FIG. 2.

Legs 24L,C,R, illustrated in FIGS. 1 and 7, are made of rigid, elongated tubing or the like of a predetermined size, length, shape, and thickness, and should have dimensional characteristics at one end so as to permit insertion into corresponding leg receivers 20L,C,R, with reasonable ease. In addition, the gaps between the receiver inside surfaces and the leg outside surfaces should be kept as minimal as possible. A leg securing hole or holes 26 are formed in one end of each leg, aligning with corresponding holes 22 when inserted into corresponding receivers 20L,C,R. Holes 26 must be of adequate diameter so as to allow passage of a leg securing pin 28, such as a detent pin, clevis pin or the like.

At the ends of legs 24L,C,R opposite holes 26, a caster mounting plate 30 is attached to each leg in a fashion so as to position plate 30 sufficiently level when the apparatus is in the operational upright position, as is shown in FIG. 1. The caster mounting plate is made of flat, rigid material of a desired size, shape, and thickness, and having caster plate holes 32, slots, or the like formed in such a pattern so as to correspond to standard caster mounting plate configurations. A caster 36 is secured to plate 30 by caster mounting bolts 34 and their respective hardware.

A mast 38, illustrated in FIGS. 1-5, 8 and 9, is made of rigid, elongated tubing, I-beam or the like of a predetermined size, length, shape, and thickness. It is attached along one end to plate 12B, being positioned flatly upon and centered within the plate surface, as well as parallel to the plate outside edges that are adjacent to bridge 14. Mast 38, where attached to plate 12B, should be correctively angled by bending, cutting, etc., to compensate for its respective plate angle, if necessary. This ramification should result in mast 38 being reasonably perpendicular to the working surface when the apparatus is in its operational upright position.

A latch securing brace 42, shown in FIGS. 1-4, comprises a C-shaped rigid material, and is attached to mast 38 upon the surface opposite the leg receivers 20L,C,R, with the base length of the brace positioned parallel to bridge 14. Brace 42 should have the legs of its C-shaped design attached to the mast surface at their endmost points, positioning them perpendicularly to their respective mating surface.

As illustrated in FIGS. 1-4, a cable securing hook 44, made of a rigid material of a desired size and shape, such as L-shaped, curved, etc., is attached to mast 38 upon the surface opposite brace 42. Hook 44 is positioned with reasonable perpendicularity with respect to the mating surface, so as to permit a cable terminal 110, shown in FIG. 1, to be placed about as well as removed from hook 44 with reasonable ease.

A plurality of jib height adjustment holes 46, illustrated in FIGS. 1-5 and 8, is formed along the surfaces of the mast adjacent to brace 42. Holes 46 are to be of a predetermined diameter, position, and quantity. They should align sufficiently with the corresponding holes of their opposing surface so as to permit passage of a jib bracket lock-pin 66, such as a wire locking-pin or the like.

Two arm pivot braces 56, as shown in FIGS. 1-5, are made of flat, rigid material of a desired size, shape, and thickness, and are attached to mast 38 upon the surface common to brace 42. Braces 56 are positioned perpendicularly with respect to their mating surface, and sufficiently parallel with respect to each other. Braces 56 include a hole formed in each, having a sufficient diameter and being positioned in alignment with one another so as to adequately permit passage of an arm pivot pin 92, such as a clevis pin or the like, simultaneously.

A mast cable slot 54, as is illustrated in FIG. 5, is formed in the mast surface common to braces 56, and is positioned between braces 56 and the end of mast 38 opposite assembly 10. Slot 54 should be of adequate dimensions so as to allow the unrestricted passage of a cable 108, also shown in FIG. 5.

Upon the surface of mast 38 opposite of and in alignment with slot 54, a sheave#1 slot 50 is formed, as is illustrated in FIGS. 1 and 5. Slot 50 must be of adequate dimensions so as to permit passage of a sheave#1 48, which should be recessed within mast 38, and having a desired portion of its mass protruding outside of slot 50. A hole of a predetermined diameter and position is formed in each mast surface adjacent to slot 50. The two holes should align sufficiently, so as to permit passage of a sheave#1 pin 52, such as a clevis pin or the like, simultaneously. Once sheave 48 bore is positioned between the two holes, pin 52 is inserted, forming an axle about which sheave 48 may rotate.

A jib assembly 58, shown in FIGS. 1, 2, 4 and 5, is comprised of: a jib mounting bracket 60; a boom 68; two sheave#2 braces 80; a boom support 84; a jib pivot brake 86.

Bracket 60, as is illustrated in FIGS. 1-5, is made of a segment of rigid, C-shaped channel material of a predetermined size, length, and thickness. A portion of the channel material's base is removed from one end, resulting in the length of the legs of the channel material being longer than that of the base at this altered end.

Two jib bracket slots 62, shown in FIGS. 1-5, are formed in the sections of the bracket legs which extend beyond the base of the channel piece. Slots 62 should be of adequate diameter and alignment with respect to each other so as to allow passage of pin 66. Slots 62 should be of sufficient length so as to accommodate the pivoting of assembly 58 when attached to mast 38 with pin 66.

As shown in FIG. 2, at the ends of the legs of bracket 60 opposite slots 62, two jib bracket holes 64 are formed. Holes 64 must be of adequate diameter and alignment with respect to each other so as to allow passage of pin 66.

As is illustrated in FIGS. 1, 2, and 4-6, boom 68 is made of a segment of rigid, elongated tubing, I-beam, or the like, of a desired size, length, shape, and thickness. It is attached at one end to the outside base surface of bracket 60, toward the end with holes 64. At the other end of boom 68, a boom cable slot 76, shown in FIG. 6, is formed in the surface facing the altered end of bracket 60 base. Slot 76 should be formed of adequate dimensions so as to allow the unrestricted passage of cable 108.

Upon the surface of boom 68 opposite of and in adequate alignment with cable slot 76, a sheave#3 slot 72 is formed, as illustrated in FIG. 6. Slot 72 must be of adequate dimensions so as to permit the passage of a sheave#3 70, which is to be recessed within the boom, and having a desired portion of its mass protruding outside of sheave slot 72. A hole of predetermined diameter and position is formed in each boom surface adjacent to sheave slot 72. The two holes must align sufficiently, so as to permit passage of a sheave#3 pin 74, such as a clevis pin or the like, simultaneously. Once sheave 70 bore is positioned between the two holes, pin 74 is inserted, forming an axle about which sheave 70 may rotate.

Braces 80, shown in FIGS. 1, 2, 4, and 5, are made of flat, rigid material of a predetermined size, shape, and thickness, and are attached to both boom 68 and bracket 60. They are positioned perpendicularly with respect to their mating surfaces, and sufficiently parallel with respect to each other. The spacing of braces 80 must adequately permit the insertion of a sheave#2 78 between them. A hole formed in each of braces 80 of a predetermined diameter and position are to be aligned with respect to each other so as to allow passage of a sheave#2 pin 82, such as a clevis pin or the like, simultaneously. Once sheave 78 bore is positioned between the two holes, pin 82 is inserted, forming an axle about which sheave 78 may rotate.

Support 84, illustrated in FIGS. 1-5, is made of a segment of rigid, elongated tubing, I-beam, or the like, of a predetermined size, length, shape, and thickness. It is attached at one end to the surface of bracket 60 that is common to boom 68, and in close proximity to the altered edge of the bracket base. It should be positioned at an angle so as to aim toward the intended support point along the span of boom 68. Support 84 has angled ends so as to achieve a maximum surface area of contact along bracket 60 as well as along boom 68.

The jib pivot brake 86, shown in FIGS. 1-5, is made of a flat, rigid material of a predetermined size, shape, and thickness. Brake 86 is attached to support 84, perpendicularly with respect to its mating surface, which should be facing slot 76. In the preferred embodiment, brake 86 should have an outside edge parallel to the lengthwise dimension of boom 68.

As is illustrated in FIGS. 1-5, a male arm piece 88, made of a segment of rigid, elongated tubing or the like of a predetermined size, length, shape, and thickness, includes two or more holes of a desired diameter formed at one end. The holes should be located opposite each other and positioned so as to sufficiently align with the holes in braces 56, when the arm piece is inserted between them. Arm piece 88 is attached to braces 56 by inserting a pivot pin 92, such as a clevis pin or the like, through both braces 56 and the holes in the end of arm piece 88, simultaneously. A plurality of arm length adjustment holes 90 of a predetermined diameter, position, and quantity, are formed along two opposing sides of arm piece 88 and should have sufficient alignment with respect to one another so as to permit passage of an arm length adjustment pin 96, such as a detent pin or the like, simultaneously.

Figure 3:
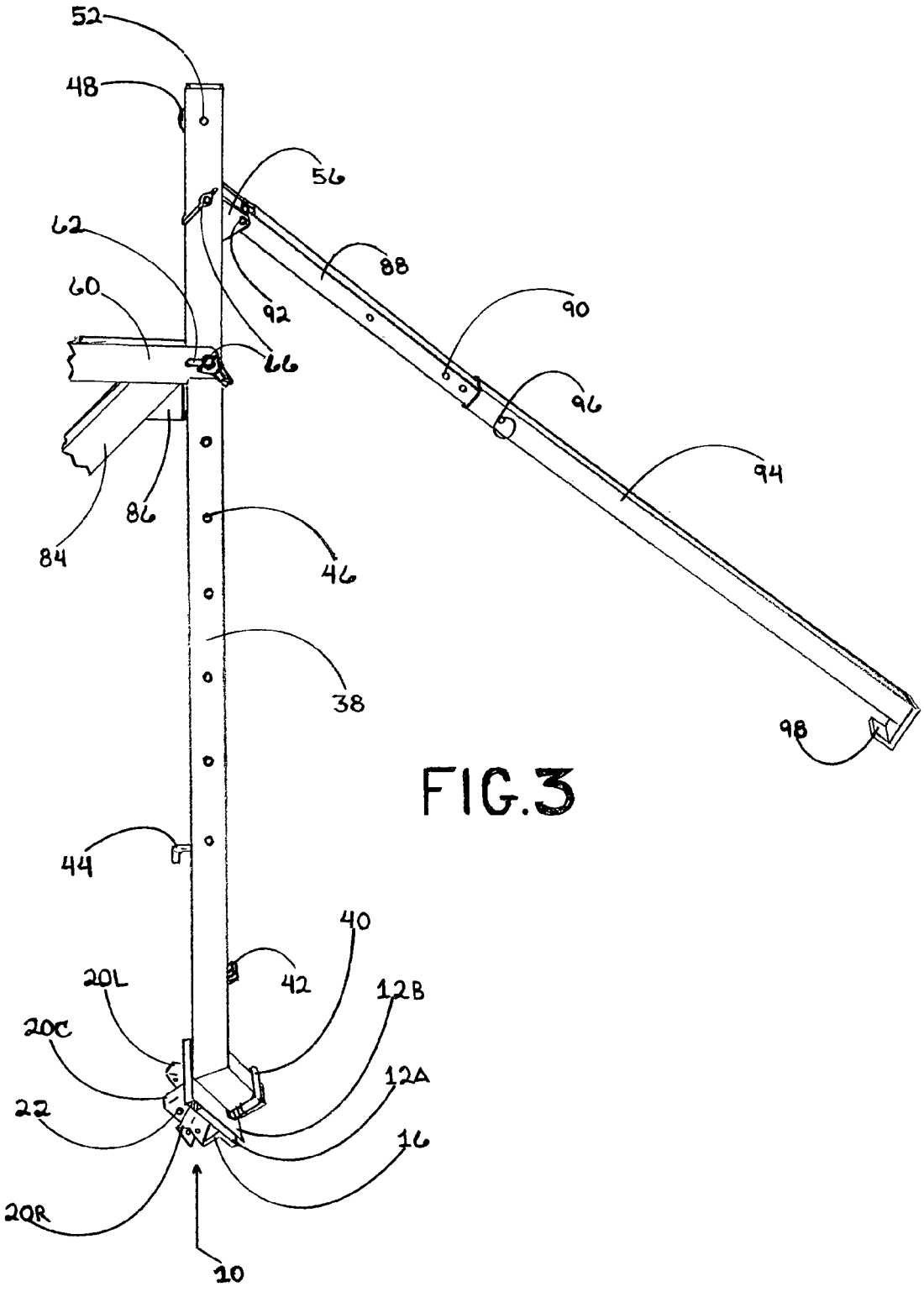
FIG. 3 shows the hoist arm in an alternative position, illustrating both the pivotal and telescopic characteristics necessary for collapsing as well as adapting to hand truck frames of various dimensions.

As is shown in FIGS. 1-3, a female arm piece 94 is made of a segment of rigid, elongated tubing, or the like, of a predetermined size, length, shape, and thickness. In the preferred embodiment, the inside dimensions of arm piece 94 should be greater than the outside dimensions of arm piece 88, so as to allow a telescopic feature when placed about arm piece 88. Two or more holes of a predetermined diameter and position are formed in opposing sides of arm piece 94. These holes should align with their corresponding holes 90 once arm piece 94 is at the desired position about arm piece 88. Arm piece 94 is attached to arm piece 88 by inserting pin 96 through both arm pieces simultaneously, while they are in a telescopic position in relation to one another.

A latch 98, illustrated in FIGS. 1-3, is made of a flat, rigid material of a predetermined size, shape, and thickness. It is attached to one end of arm piece 94, so as to cradle the handle of a hand truck 100, shown in FIG. 1, when the attached arm piece slides in a telescopic motion about arm piece 88, toward braces 56.

As is shown in FIG. 1, a winch 102 is mounted to arm piece 94 and positioned so as to feed and retrieve its cable or the like toward or from sheave 48. The winch may be permanently attached to arm piece 94 or fastened to it with common winch mounting hardware. For example, a winch mounting bolt 104 and a winch mounting strap 106, or U-bolt, may be employed.

Also in FIG. 1, cable 108 is shown to be routed from the reel of winch 102 through slot 54, about sheave 48, through slot 50, between sheave 78 and bracket 60, about sheave 78, about sheave 70, through slot 72 and finally through slot 76. A teardrop shape or its equivalent is typically formed at the end of the cable by installing common rigging hardware, such as a cable terminal 110 and a grab hook 112.

In operation of this invention, a hole or holes should first be formed in the nose plate of truck 100 in alignment with holes 18, if adapter assembly 10, when properly mounted, has holes 18 positioned anywhere within the nose plate surface area of truck 100.

The frame of truck 100 is then placed horizontally on the working surface, with the nose plate aiming in an upward direction.

With the invention in the collapsed and upright position, as is illustrated in FIG. 2, hook 44 and brake 86 secure the apparatus to one side of mast 38, while winch 102 and brace 42 secure it on the opposite side, via cable 108. In this position, assembly 10 is then placed upon the nose plate of truck 100, sandwiching it between plate 12A and plate 12B. At this point, the apparatus is resting its weight entirely upon the nose plate of truck 100, by bridge 14 engaging the topmost outside edge of the nose plate of truck 100. Holes 18 should then be aligned with the corresponding preformed nose plate holes, if applicable. Strap 40 or the like is then inserted through holes 18 and the nose plate holes, simultaneously. Strap 40 should then be secured with the preferred respective hardware, such as nuts, washers, etc.

Pin 96 is then removed from arm piece 94. Winch 102, secured to arm piece 94 with bolt 104 and strap 106, is then operated so as to feed cable 108 toward sheave 48, thus lowering arm piece 94, as well as preventing it from moving to an undesirable position. This telescoping motion disengages latch 98 from brace 42. At this point, arm piece 88 should be pivoted outward and upward, away from adapter assembly 10, rotating about pin 92, which is secured to braces 56. The resulting position is shown in FIG. 3.

An additional length of cable 108 is then fed from winch 102 as necessary, so as to allow arm piece 94 to move to a position whereas latch 98 can cradle the handle of truck 100 with reasonable ease. Once latch 98 is in the desired position, cable 108 is retrieved toward winch 102 until latch 98 engages the handle of truck 100. Pin 96 is then reinserted through both arm pieces, as the alignment of the nearest holes 90 dictates, resulting in the position illustrated in FIG. 1.

With adequate slack in cable 108, terminal 110 is then disengaged from hook 44 by grasping it and pulling it in a downward and outward motion, away from mast 38.

Figure 4:
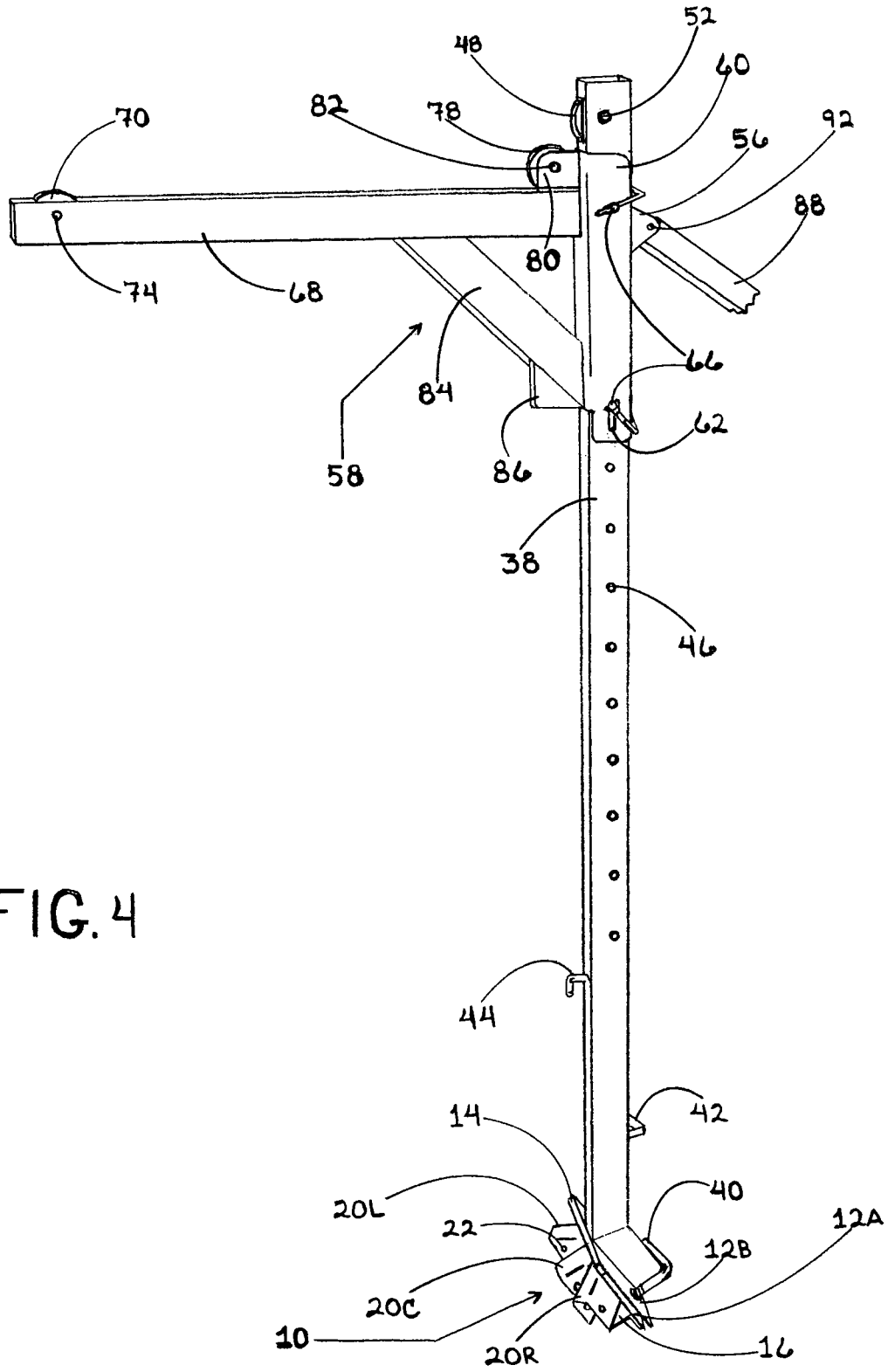
FIG. 4 shows the jib assembly secured to the mast in the operational position.

Once terminal 110 is disengaged from hook 44, and with slots 62 bearing pin 66, assembly 58 is pivoted upward and outward away from adapter assembly 10. This pivoting motion is created by bracket 60 rotating about pin 66, which is secured to mast 38 through slots 62 and holes 46. This motion ceases when the inside base surface of bracket 60 engages the surface of mast 38 that is facing bracket 60, or when holes 64 sufficiently align with holes 46. The second pin 66 should then be installed at the top of bracket 60 to secure it, if at the desired height. This resulting position is shown in FIGS. 1, 4 and 5.

However, if another jib height setting is desired, pin 66 that secures assembly 58 may be removed and assembly 58 slid up or down the mast, until slots 62 and holes 64 align with their respective holes 46. Bracket 60 can then be secured to mast 38 with pins 66.

Legs 24L,C,R are then inserted into their corresponding leg receivers 20L,C,R, and rested upon brace 16, as is shown in FIGS. 1 and 7. Once holes 22 align with holes 26, pins 28 should be inserted.

If casters 36 are not already attached to plates 30, they should be attached by inserting bolts 34 through holes 32 as well as through the corresponding factory supplied mounting holes in the caster brackets. The recommended respective hardware, such as nuts, washers, etc., is then fastened, securing the casters to plates 30.

Truck 100 is then lifted by grasping its handle and pulling the frame upward, so as to rotate it about its axial components until casters 36 engage the working surface. By holding the handle of truck 100 with both hands and manually pushing and/or pulling it while walking behind it, the apparatus is transported to the desired working area.

Once terminal 110 is in the desired proximity of the load that is to be lifted, a grappling device such as hook 112 may be attached, as shown in FIG. 1. Hook 112 or the like should then be attached to the load or its respective rigging, feeding or retrieving cable 108, if necessary, by operating winch 102 as the situation necessitates.

When cable 108 is safely secured to the load, the operator holds the handle of truck 100 firmly with one hand while operating winch 102 using the free hand, so as to retrieve the cable toward the winch reel until the load is elevated, disengaging its supportive surface or structure. While raising the load, cable 108 travels along the groove surfaces of sheave 48, sheave 78, and sheave 70, via slot 50, slot 72, slot 54 and slot 76, simultaneously. Sheave 48 rotates freely about pin 52, which is secured to mast 38. Sheave 78 rotates freely about pin 82, which is secured to braces 80. Sheave 70 rotates freely about pin 74, which is secured to boom 68. Once the load is suspended, boom 68 and boom support 84 bear much of the load stress, as do adapter plates 12A and 12B.

Holding the handle of truck 100 with both hands, the operator may then transport the load to the desired work area by manually pushing and/or pulling the apparatus while walking behind it, eventually centering the suspended load directly above the surface or structure of intended engagement. When the transporting motion ceases, the operator releases one hand from the handle and uses this free hand to operate the winch, so as to feed the cable toward sheave 48, while firmly holding the truck handle with the other hand.

Once the load safely engages the desired surface or structure to the point that sufficient slack is in cable 108, the rigging means may be disengaged and the grappling device removed. Collapsing and securing of the apparatus is the opposite of set-up.

ALTERNATIVE EMBODIMENTS

In an alternative embodiment, assembly 10 may also be fabricated as a single casting, with sockets to hold the respective components, such as a mast 38 and legs 24L,C,R.

Plates 12A,B and bridge 14 may be replaced by a single longer plate that is fashioned so as to form the necessary U-shape.

Figure 9:
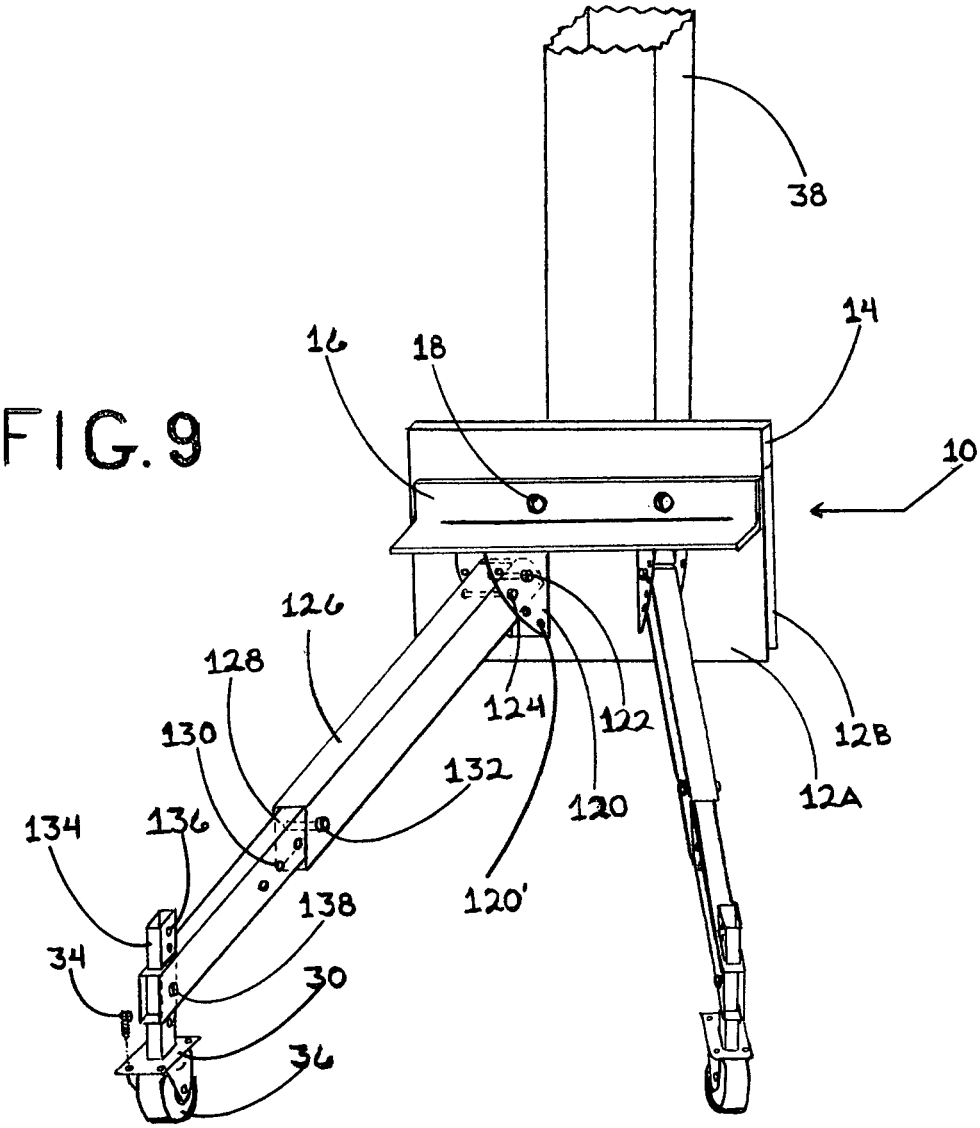
FIG. 9 shows an alternative embodiment design of the adapter assembly and legs.

Additionally, adjustable leg components may be used to better adapt to the wide array of available hand trucks. For instance, as is illustrated in FIG. 9, leg pivot brackets 120 may replace receivers 20, providing a pivoting leg adjustment feature by using leg pivot pins 122, leg pivot lock-pins 124, and a plurality of leg pivot adjustment holes 120'. Brace 16 may be positioned however necessary to accommodate this feature.

The legs themselves may be made of a female leg piece 126 and a male leg piece 128 which, when combined, provide a telescopic feature so as to allow for custom leg length adjustments. A plurality of leg length adjustment holes 130 should be formed in one of the pieces, allowing a leg length lock-pin 132 to be inserted through preformed holes in leg piece 126 and holes 130, so as to secure the leg at the desired length.

A caster post 134 may be perpendicularly attached to plates 30, having a plurality of caster post adjustment holes 136. Post 134 should pass through the bottom and top surfaces of leg piece128, providing height adjustment by aligning holes 136 with preformed holes in leg piece 128, and inserting a caster post lock-pin 138, so as to secure the post at the desired height.

As with assembly 10, assembly 58 may be fabricated of a single casting with a socket or sockets to accommodate respective components, such as boom 68 as well as sheave 78. As shown in FIG. 8, it may also comprise caged roller bearings 116 or the like, creating a jib trolley 114 embodiment, allowing a vertical movement of the assembly up and down the mast, with cable 108 attached by employing a bolt shackle 118 or the like.

All telescoping parts may also be designed so as to reverse the male and female roles, such as arm piece 88 with arm piece94, and leg piece 126 with leg piece 128.

In order to accommodate P-handle style hand trucks, latch 98 may be designed accordingly, so as to straddle the P-handle by implementing a split-latch tandem feature to maintain a centered arm piece 94, when the latch is fully engaged.

CONCLUSION, RAMIFICATIONS AND SCOPE

Accordingly, the reader will see that this invention can be easily transported to rooftops and navigate tight areas such as pump rooms and mechanical equipment rooms quickly and diligently. It has several advantages over hoists currently available in that

- it is light weight and easy to carry;
- it can be collapsed and stored on a service vehicle without crowding the vehicle;
- it permits one person on a rooftop to quickly perform the work of two people and;
- it provides a low profile cable design and level boom with several height settings, making it capable of surgically removing heavy items from tight compartments.

Although the above description contains many specifics, these should not be construed as the sole scope of the invention. As is shown in the illustrations, for example, several other shapes, structural embodiments and materials may be used. A trolley style jib assembly with caged roller bearings can replace the fixed style jib; extendable pivoting legs with adjustable height casters may be employed; cast parts can replace assemblies, etc.

Thus the full scope of the invention should be determined by the appended claims, rather than merely the examples given.

What is claimed is:

1. A portable hoist attachable to and for use in combination with a hand truck comprising:

(a) an adapter assembly comprising: a rigid u-shaped embodiment formed by two flat plates bridged to one another, substantially parallel with respect to one another and sufficiently spaced apart from one another so as to allow said u-shaped embodiment to sandwich a nose plate of said hand truck; a segment of angle iron attached to an outer surface of one of said two flat plates and positioned parallel with respect to the bridge of said u-shaped embodiment, rendering one leg of said segment of angle iron perpendicular to said outer surface and; at least one c-shaped leg receiver attached to said one leg of said segment of angle iron;

(b) at least one leg for load support made of elongated tubing and having adequate outside dimensional properties so as to allow for insertion of said at least one leg into an open end of said at least one c-shaped leg receiver, one end of said at least one leg having a flat plate attached so as to permit the attachment of a caster to increase mobility of said portable hoist when in use;

(c) a mast made of elongated tubing attached at one end to an outer surface of said u-shaped embodiment opposite said at least one c-shaped leg receiver;

(d) a jib assembly attachable to said mast comprising: a jib mounting bracket made of c-shaped channel, the inside dimensions of which conforming to the width and at least partial depth dimensions of said mast; a boom made of elongated tubing attached at one end to an outer surface of said jib mounting bracket and substantially perpendicular with respect to said jib mounting bracket and; a boom support made of elongated tubing attached to said jib mounting bracket at one end and attached to said boom at the opposing end;

(e) a rotatable sheave attached to said boom so as to allow a cable to be utilized via said jib assembly and;

(f) an arm made of elongated tubing, attachable at one end to said mast and attachable at an opposing end to a handle of said hand truck, forming a contiguous brace to maintain the proximities of both said mast and said hand truck with respect to one another when said hoist is in the upright operational position and providing a surface upon which to attach a winch in such a fashion as to physically permit the operator of said hoist to grasp said handle of said hand truck with one hand while operating said winch with the other hand.

2. The portable hoist according to claim 1 wherein said mast carries a rotatable sheave at the end opposing said adapter assembly.

3. The portable hoist according to claim 1 wherein said mast provides a plurality of attachment points for said jib mounting bracket to incorporate a multitude of possible height settings for said jib assembly.

4. The portable hoist according to claim 1 wherein said arm is pivotably attached to said mast.

5. The portable hoist according to claim 1 wherein said arm is comprised of two telescopic pieces of elongated tubing, said pieces having a means of securing a multitude of combined lengthwise dimensions.

6. The portable hoist according to claim 1 wherein said jib assembly carries a plurality of sheaves to assist in load lifting.

* * * * *